US005081908A

United States Patent [19]

McBeth et al.

[11] Patent Number: 5,081,908

[45] Date of Patent: Jan. 21, 1992

[54] HYDRAULIC PUMP HAVING FLOATING SPIGOT VALVE

[75] Inventors: James B. McBeth, N. Vancouver; Eric Fetchko, Burnaby, both of Canada

[73] Assignee: Teleflex Incorporated, Limerick, Pa.

[21] Appl. No.: 697,094

[22] Filed: May 8, 1991

[51] Int. Cl.[5] ..... F01B 1/00

[52] U.S. Cl. ..... 91/499; 91/503

[58] Field of Search ..... 91/503, 499, 501, 507

[56] References Cited

U.S. PATENT DOCUMENTS

| | | | |
|---|---|---|---|
| 1,722,832 | 7/1929 | West . | |
| 1,925,378 | 4/1931 | Ferris et al. . | |
| 1,970,133 | 8/1934 | Ferris et al. . | |
| 2,190,066 | 2/1940 | Hawley, Jr. . | |
| 2,213,236 | 9/1940 | Benedek . | |
| 2,520,632 | 8/1950 | Greenhut . | |
| 2,918,879 | 12/1959 | Cervo . | |
| 2,997,956 | 8/1961 | Stewart . | |
| 3,034,451 | 5/1962 | Sullivan et al. . | |
| 3,067,694 | 12/1962 | Fancher . | |
| 3,200,762 | 8/1965 | Thoma | 91/501 |
| 3,246,575 | 4/1966 | Raymond | 91/503 |
| 3,280,757 | 10/1966 | Eickmann . | |
| 3,385,226 | 5/1968 | Thoma . | |
| 3,407,745 | 10/1968 | North et al. . | |
| 3,411,453 | 11/1968 | Chanal . | |
| 3,429,231 | 2/1969 | Raymond | 91/503 X |
| 3,511,135 | 5/1970 | Ife et al. | 91/499 X |
| 3,747,176 | 7/1973 | Ankeny et al. | 91/489 |
| 4,007,663 | 1/1975 | Nagatoma et al. | 91/6.5 |
| 4,073,603 | 2/1978 | Abendschein et al. | 417/222 |
| 4,174,191 | 11/1979 | Roberts | 417/222 |
| 4,211,148 | 7/1980 | Boss | 91/499 |
| 4,215,624 | 8/1980 | Toias | 91/499 |
| 4,745,748 | 5/1988 | Hayashi et al. | 60/489 |

*Primary Examiner*—Leonard E. Smith

*Attorney, Agent, or Firm*—Reising, Ethington, Barnard, Perry & Milton

[57] ABSTRACT

A manual hydraulic helm pump (10) for actuating a remote submerged steering element in a boat includes a drive shaft (26) rotatably supported in a housing (12). A rotary cylinder block (32) disposed in the housing (12) is fixed to the drive shaft and includes a plurality of axial compression chambers (40). The cylinder block (32) is supported at one end by a roller bearing (34) and at the other end by the drive shaft (26). Each of the compression chambers (40) include a slidable piston (42) biased outwardly against an angular swash plate (50). A spigot-type timing valve (52) is nonrotatably supported within the cylinder block. A transfer valve (59) is fixed relative to the housing (12). A pair of tubular connector sleeves (72*a*, 72*b*) movably interconnect the timing valve (52) and the transfer valve (59). O-ring seals (71*a*, 71*b*) are provided at each end of the two connector sleeves (71*a*, 72*b*) for maintaining a fluid tight seal while permitting the timing valve (52) to minutely orbit relative to the transfer valve (59).

22 Claims, 6 Drawing Sheets

HYDRAULIC PUMP HAVING FLOATING SPIGOT VALVE

TECHNICAL FIELD

The subject invention relates to manually operated hydraulic piston pumps, and more particularly to an axial piston pump having a nonrotatable spigot-type timing valve operatively transferring and receiving hydraulic fluid from a rotating cylinder block.

BACKGROUND ART

Boats and other marine craft typically include a submerged steering element, such as a rudder or a moveable outboard propulsion unit. The boat is steered from the helm which is located remotely from the submerged steering element. Many boats include a manually operated hydraulic helm pump for hydraulically actuating the submerged steering element. The helm pump typically includes a plurality of pistons reciprocated in respective compression chambers against an actuator means for reciprocating the pistons in their compression chambers. An inclined swash plate is a typical such actuator means.

The helm steering wheel is usually connected directly to a drive shaft which, in turn, rotates a rotary cylinder block containing the plurality of compression chambers. A timing valve is nonrotatably disposed with respect to the cylinder block but communicates therewith to alternately transfer hydraulic fluid to and from the compression chambers without leakage therebetween. A fixed transfer valve simultaneously transfers hydraulic fluid between the timing valve and the rest of the hydraulic steering system.

A common problem with prior art helm pumps is that the rotary cylinder blocks are usually supported for rotation directly on the timing valve, and the timing valve is, in turn, rigidly fixed to the transfer valve. Because the timing valve does not rotate and remains rigidly fixed to the transfer valve, considerable wear occurs at the sliding interface between the timing valve and the cylinder block. Over time, this wear diminishes the fluid tight seal between the timing valve and the cylinder block and allows the pressurized hydraulic fluid to leak from the interface, resulting in pump inefficiencies.

The prior art has recognized this problem and sought to alleviate the undesirable wearing and resultant leakage problem by supporting the rotating cylinder block independently of the timing valve. Also, the prior art has disjointed the timing valve from the transfer valve so that the timing valve is permitted to float, or minutely orbit, as the cylinder block rotates thereabout, with the minute orbit of the timing valve being due to any slight manufacturing inaccuracies in the cylinder block and/or the timing valve.

Two such examples of the prior art may be had in the U.S. Pat. No. 1,925,378 to Ferris et al., issued Sept. 5, 1933 and the U.S. Pat. No. 3,280,757 to Eickmann, issued Oct. 25, 1966. In Ferris et al., the minutely orbital timing valve is connected to the fixed transfer valve by a long tubing having a series of loops formed therein to permit the necessary flexibility. The disadvantage of Ferris et al. is that considerable space must be provided inside the pump housing for the long, looping flexible tubes. In Eickmann, a spherically curved interface is provided between the moveable timing valve and the fixed transfer valve. The disadvantage of Eickmann is that a leak proof spherically curved interface is difficult to maintain over time and is expensive to manufacture in high production. Also, because of the spherical curvature, the timing valve is only permitted to orbit in a conical path. The timing valve cannot orbit in a circular path and still maintain a fluid tight seal with the transfer valve.

SUMMARY OF THE INVENTION AND ADVANTAGES

The subject invention provides a hydraulic pump assembly for a marine steering system for remotely actuating a submerged steering element. The subject assembly comprises a housing, a compression chamber disposed in the housing, a piston slidably disposed in the compression chamber, and an actuator means for reciprocating the piston in the compression chamber in response to a rotary input. A timing valve means is minutely orbitally disposed in the housing for alternately transferring hydraulic fluid to and from the compression chamber, and a transfer valve means extends through the housing and is fixed relative to the minutely orbital timing valve means for conveying hydraulic fluid between the steering system and the timing valve means. The subject assembly is characterized by an annular elastically deformable seal means interconnecting the fixed transfer valve means and the minutely orbital timing valve means over an annular surface area for permitting minute orbital movements of the timing valve means while perfecting and maintaining an annular fluid tight seal with the transfer valve means such that the timing valve means is permitted to freely minutely orbit without leakage of hydraulic fluid between itself and the fixed transfer valve means.

The subject assembly overcomes the disadvantages of the prior art by its annular seal means being elastically deformable to permit minute orbits, or a slight floating, of the timing valve means relative to the transfer valve. The seal means can be very small, thereby conserving valuable space within the housing. The seal means is also inexpensive to manufacture, and further allows the timing valve means to orbit in a circular path while maintaining a leak proof seal.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT OF FIGS. 1-7

Referring to FIGS. 1-7, wherein like numerals indicate like or corresponding parts throughout the several views, a hydraulic helm pump according to the subject invention is generally shown at 10. The helm pump 10 is manually operated to control, or actuate, a submerged steering element in a boat or other marine craft, neither of which are shown in the Figures. In most boats, the submerged steering element comprises a rudder or a moveable outboard propulsion unit. The helm pump 10 mounts either in front of or behind the helm dashboard for direct connection to the helm steering wheel (not shown). The boat is thus steered from the helm which is located remotely from the submerged steering element.

Figure 1:
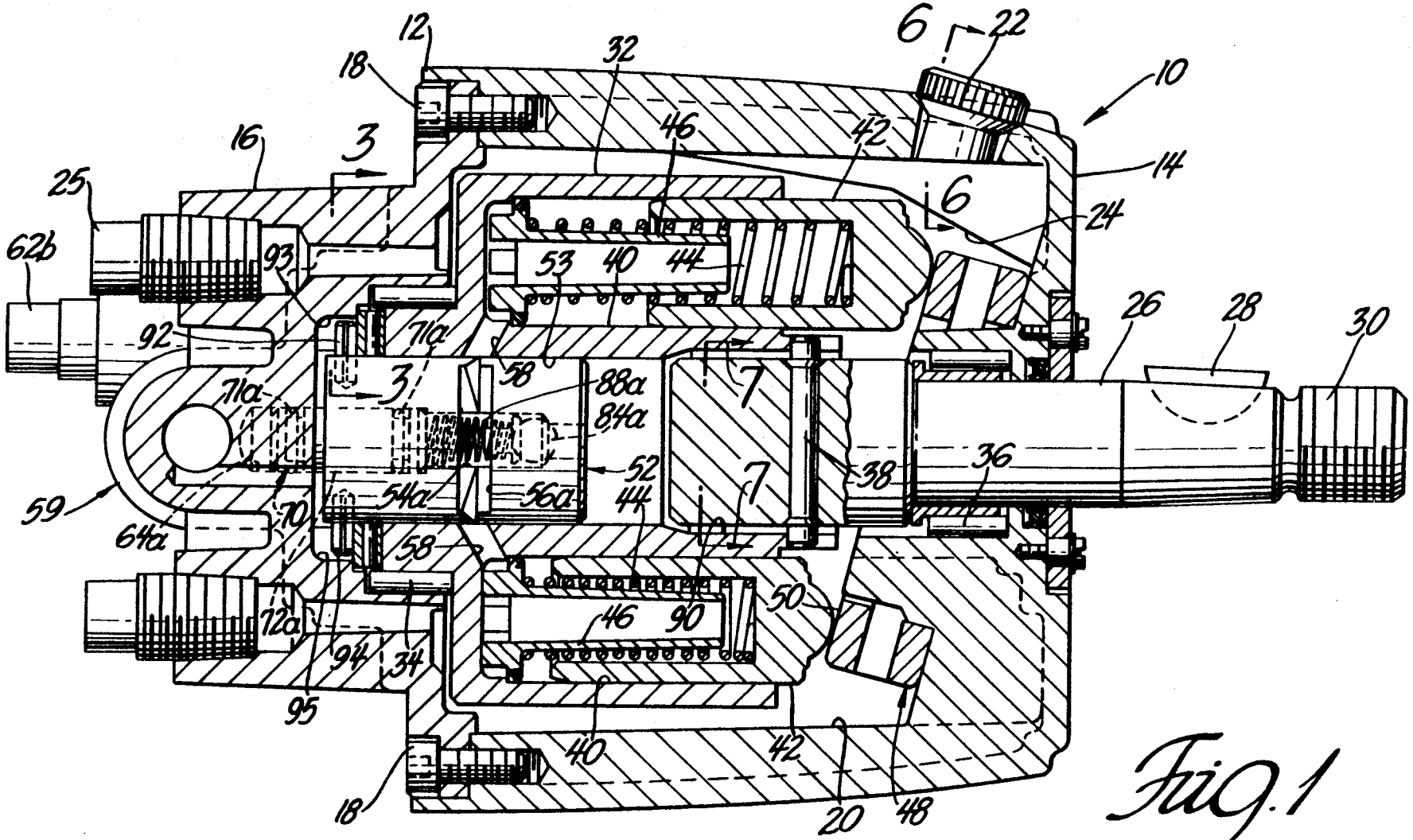
FIG. 1 is a cross-sectional view of an axial piston hydraulic helm pump according to the subject invention.

The subject helm pump 10 includes a housing 12 arranged in a two-piece construction. Particularly, a generally cup-shaped forward section 14 and a cap-like rearward section 16 are secured together by plurality of screws 18 to form the housing 12. Fastened together as shown in FIG. 1, the forward 14 and rearward 16 sections form a sealed internal pump chamber 20. The chamber 20 creates a reservoir for hydraulic fluid used as a make-up supply of hydraulic fluid when needed.

Figure 6:
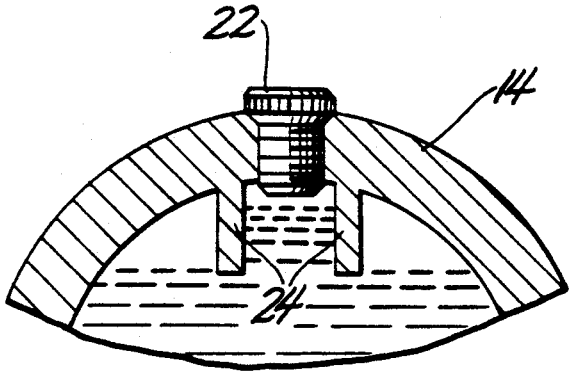
FIG. 6 is a fragmentary cross-sectional view as taken along line 6—6 of FIG. 1.

A filler plug 22 is threadably disposed through the housing 12 for adding hydraulic fluid to the helm pump 10. The housing 12 includes a means for accommodating thermal expansion of the hydraulic fluid retained therein. A pair of angular thin-walled ribs 24 are disposed on opposite sides of the filler plug 22 and extend inwardly from the forward section 14, generally parallel to one another, as shown in FIG. 6. The purpose of the ribs 24 is to create two air pockets within the chamber 20 upon filling the chamber 20 with hydraulic fluid. This is accomplished by the ribs 24 trapping air on the laterally outward sides thereof while the hydraulic fluid is filled up between the two ribs 24. The air pockets created by the ribs 24 are relatively large and permit the hydraulic fluid to expand as the temperature rises without rupturing any of the various seals or tripping a standard relief valve. Although the subject helm pump 10 will still require a pressure relief valve, the trip, or release, pressure of the relief valve can be significantly raised due to the increased ability of the helm pump 10 to withstand thermal expansion of the hydraulic fluid contained therein. Such relief valve may be incorporated into a make-up plug 25, shown in FIG. 1.

A drive shaft 26 is supported for rotation in the housing 12 and includes a central axis of rotation which is generally coaxial with the natural axis of the housing 12 and also parallel to the ribs 24. The helm steering wheel attaches directly to the drive shaft 26 and is fixed thereon with the aide of a key 28 and a fastener (not shown) secured on a threaded external end 30 of the drive shaft 26.

A barrel-like rotary cylinder block 32 is disposed within the housing 12 and secured to the rearward end of the drive shaft 26. The cylinder block 32 is rotatably supported at its rearward end by a radial roller bearing 34 and at its forward end by the drive shaft 26, which in turn, is supported on a forward radial roller bearing 36. A through pin 38 operatively interconnects the drive shaft 26 and the cylinder block 32. Hence, as an operator rotates the helm steering wheel, the drive shaft 26 is directly rotated causing rotation of the cylinder block 32 within the housing 12.

The cylinder block 32 includes a plurality of compression chambers 40, preferably seven, disposed in equal radial and arcuate increments about the central axis. The compression chambers 40 extend parallel to the central axis and thus parallel to the ribs 24 in typical axial piston pump fashion. A cup-shaped piston 42 is slidably disposed in each of the compression chambers 40. The pistons 42 are each telescopically and reciprocally disposed in the respective compression chambers 40 to alternately draw and pump hydraulic fluid, thus supplying the motive force to actuate the remote submerged steering element. A compression spring 44 is disposed in each compression chamber 40 and seated in an inner recess, or cavity, formed in each of the pistons 42 for biasing the associated piston 42 outwardly from its compression chamber 40.

A bleed tube 46 is positioned in each compression chamber 40 for assisting in the expulsion of trapped air in the hydraulic fluid. For a more detailed description of the bleed tube 46 shown in FIG. 1, reference may be had to the U.S. Pat. No. 4,898,077 to James B. McBeth, issued Feb. 6, 1990 and assigned to the assignee of the subject invention, the disclosure of which is hereby incorporated by reference.

The subject helm pump 10 further includes an actuator means, generally indicated at 48 in FIG. 1, for reciprocating each piston 42 in its compression chamber 40 in response to a rotary input at the drive shaft 26. In other words, the actuator means 48 forces the pistons 42 to move into and out of their respective compression chambers 40 for moving hydraulic fluid through the steering system. The actuator means 48 comprises an angularly supported swash plate 50 surrounding the drive shaft 26 adjacent the forward radial bearing 36. In a typical arrangement, the compression springs 44 urge their respective pistons 42 forwardly toward the swash plate 50. Because the swash plate 50 is angled, the pistons 42 are held at various positions within their compression chambers 40 at any given moment. Therefore, as the operator rotates the drive shaft 26, the cylinder block 32 is rotated, thus forcing the pistons 42 to rotate around the swash plate 50. With each revolution of the cylinder block 32, the pistons 42 are thereby moved through a complete stroke or cycle.

A timing valve means, generally indicated at 52 in FIG. 1, is minutely orbitally disposed in the housing 12 for alternately transferring hydraulic fluid to and from each of the compression chambers 40. The timing valve means 52 is a generally cylindrical member axially aligned with the drive shaft 26 and disposed in a mating cylindrical recess 53 in the center of the cylinder block 32. A close yet sliding tolerance is provided between the timing valve means 52 and the cylinder block 32. The timing valve means 52 disposed as shown in FIG. 1 is frequently referred to as a spigot-type valve.

The timing valve means 52 includes two identical and divided fluid carrying passages 54*a*, 54*b* disposed therein. During operation, one of the passages 54*a*, 54*b* conveys low pressure hydraulic fluid to the compression chambers 40 while the other passage 54*a*, 54*b* conveys high pressure hydraulic fluid from the compression chambers 40, depending upon the rotational direction of the drive shaft 26.

Figure 3:
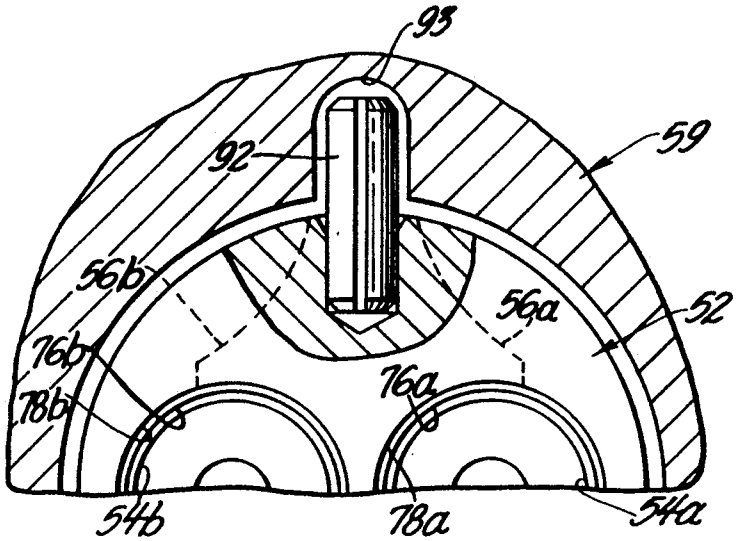
FIG. 3 is a fragmentary cross-sectional view of the timing valve means, the transfer valve means, and one of the two rigid pins as taken along line 3—3 of FIG. 1.
Figure 4:
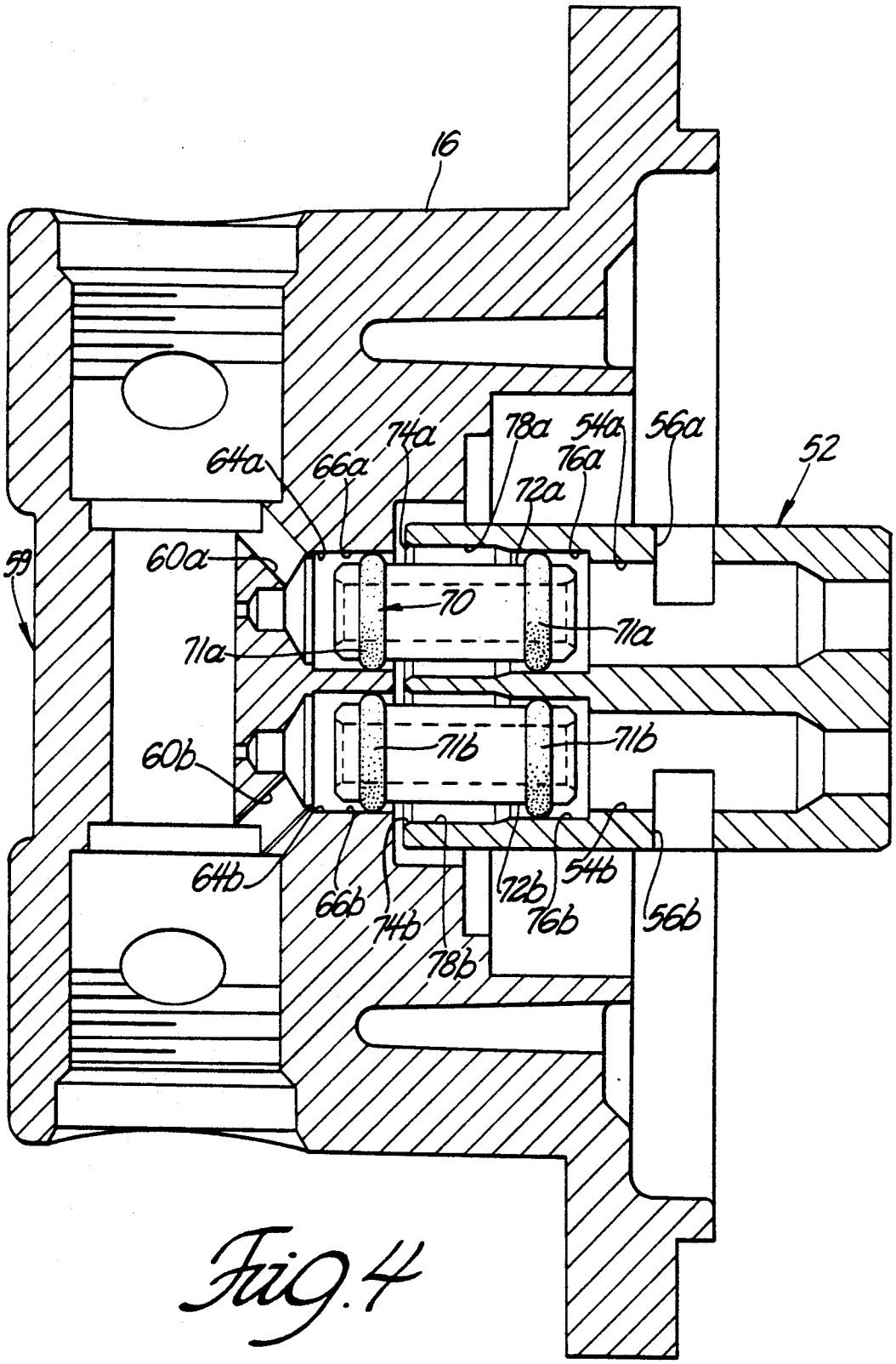
FIG. 4 is a cross sectional view of the timing valve means, the transfer valve means, and the connector sleeves in an axially aligned position.
Figure 5:
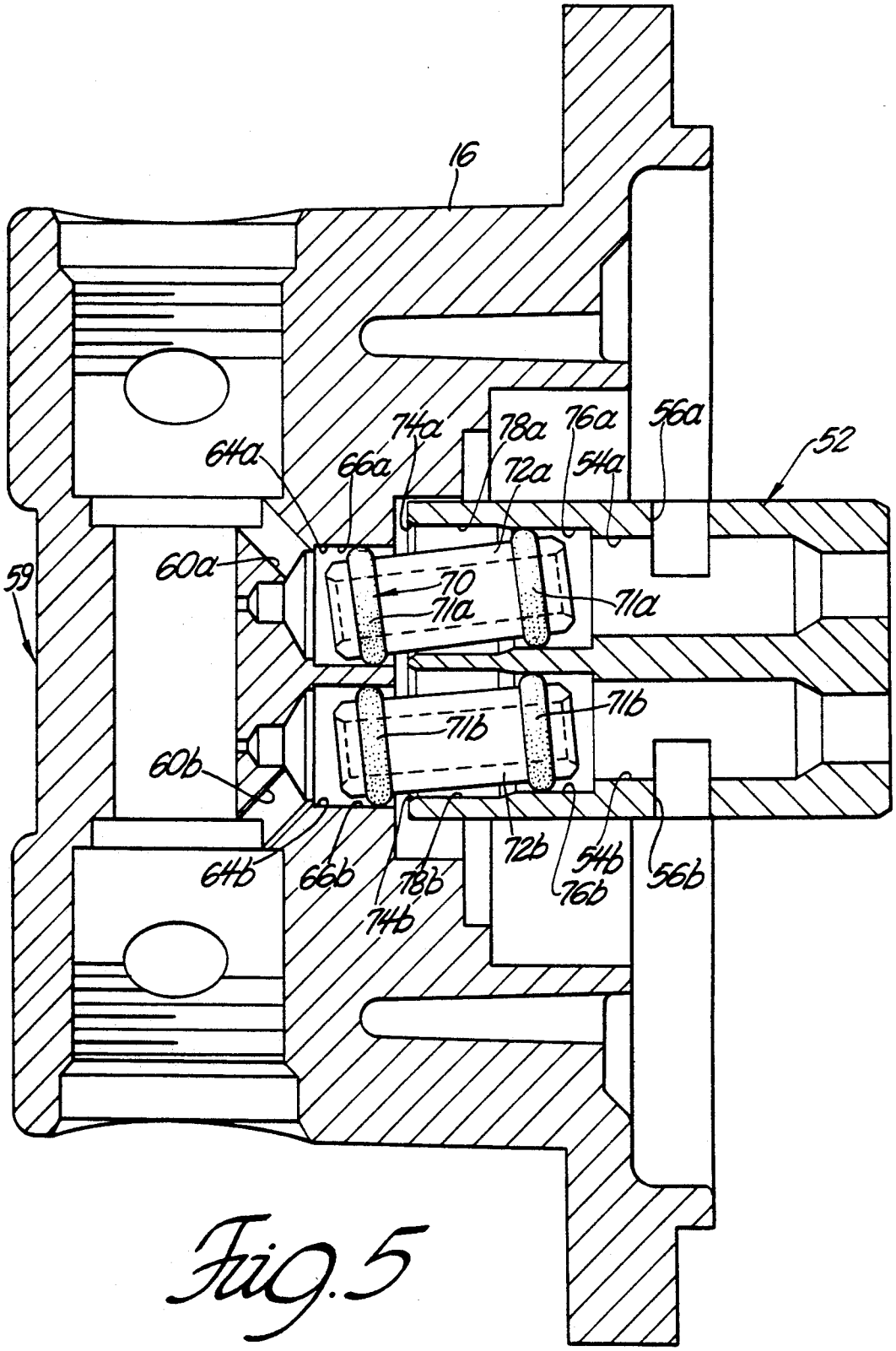
FIG. 5 is a cross-sectional view as in FIG. 4 showing the timing valve means shifted laterally from the transfer valve means and the connector sleeves angled therebetween to maintain a fluid tight seal.

As best shown in FIGS. 3 and 4–5, the passages 54*a*, 54*b* each include an arcuate transfer port 56*a*, 56*b*, respectively, extending radially outwardly to the exterior surface of the timing valve means 52. The two transfer ports 56*a*, 56*b* are separated by two short and diametrically opposed spaces along the exterior surface of the timing valve means 52. These two spaces between the ends of the transfer ports 56*a*, 56*b* are axially aligned with each of the lowest and highest points of the angled swash plate 50.

The cylinder block 32 includes a circular duct 58 extending radially inwardly along a slight skew from each compression chamber 40 toward the timing valve means 52 for conveying hydraulic fluid to and from the transfer ports 56*a*, 56*b* as the cylinder block 32 is rotated. The ducts 58 are of a diameter such that they can only communicate hydraulic fluid with one of the transfer ports 56*a* or 56*b* at a time. That is, as a piston 42 is rotated to either the lowermost or highest most point along the swash plate 50, its corresponding duct 58 will be disposed exactly over one of the spaces separating the two transfer ports 56*a*, 56*b*, and consequently will not communicate hydraulic fluid with either one of the transfer ports 56*a*, 56*b* until the cylinder block 32 is rotated further to bring the duct 58 into communication with one of the transfer ports 56*a*, 56*b*.

As mentioned above, the timing valve means 52 is minutely, or slightly, orbitally disposed in the housing 12. This is because the timing valve means 52 is free to move radially with the mating cylindrical recess 53 in the cylinder block 32. That is, due to any manufacturing inaccuracies of the cylinder block 32 and/or the timing valve means 52, one or the other may not provide a perfectly cylindrical mating surface for the other to rotate against. Also, the bearing race formed on the cylinder block 32 for the rearward radial roller bearing 34 may not be perfectly concentric with the cylindrical recess 53. Thus, because the cylinder block 32 is securely supported by the radial bearings 34, 36, the timing valve means 52 will tend to float, or move radially, or more specifically to oscillate in a circular path, within the housing 12 due to such manufacturing inaccuracies. This floating of the timing valve means 52 within the housing 12 is advantageous and not to be prevented because it minimizes the wear which would otherwise occur between the outer surface of the timing valve means 52 and the cylindrical recess 53 in the cylinder block 32 and cause leakage between the ducts 58 and the timing valve means 52.

The helm pump 10 also includes a transfer valve means, generally indicated at 59 in FIGS. 1–5, extending through the housing 12 and fixed relative to the minutely orbital timing valve means 52 for conveying hydraulic fluid between the steering system and the timing valve mean 52. As perhaps best shown in FIG. 3, the transfer valve means 59 is formed integrally with the rearward section 16 of the housing 12 and is fixedly, i.e., non-movably, secured thereto by the screws 18. The transfer valve means 59 comprises a pair of input/output passages 60*a*, 60*b* communicating with the fluid carrying passages 54*a*, 54*b* of the timing valve means 52, respectively. Each of the input/output passages include a threaded coupler portion 62*a*, 62*b* (not shown), respectively, for connection to a pair of hydraulic hoses (not shown).

The transfer valve means 59 includes a pair of generally cylindrical female transfer valve receptacles 64*a*, 64*b* on the forward side thereof for transferring hydraulic fluid to the corresponding input/output passages 60*a*, 60*b* from the fluid carrying passages 54*a*, 54*b* of the timing valve means 52, best shown in FIGS. 4 and 5. The transfer valve receptacles 64*a*, 64*b* each comprise a cylindrical transfer valve wall 66*a*, 66*b*, respectively, each leading to an angled bore of the respective input/output passages 60*a*, 60*b*. In FIGS. 4 and 5, the transfer valve means 59 is shown not including the usual spool valve assembly disposed in the common passage connecting the angled bores of the input/output passages 60*a*, 60*b*. In operation, the spool valve will prevent open fluid communication between the two input/output passages 60*a*, 60*b*.

An annular elastically deformable seal means, generally indicated at 70 in FIGS. 1, 2, 4, and 5, interconnects the fixed transfer valve means 59 and the minutely orbital timing valve means 52 over an annular surface area for permitting minute orbital movements of the timing valve means 52 while perfecting and maintaining an annular fluid tight seal with the transfer valve means 59. The seal means 70 is oriented in a plane perpendicular to the central axis so that the primarily radial elastic deformability of the seal means 70 allows the timing valve means 52 to freely minutely orbit about an axis parallel to the central axis without leakage of hydraulic fluid between the fixed transfer valve mean 59.

Figure 2:
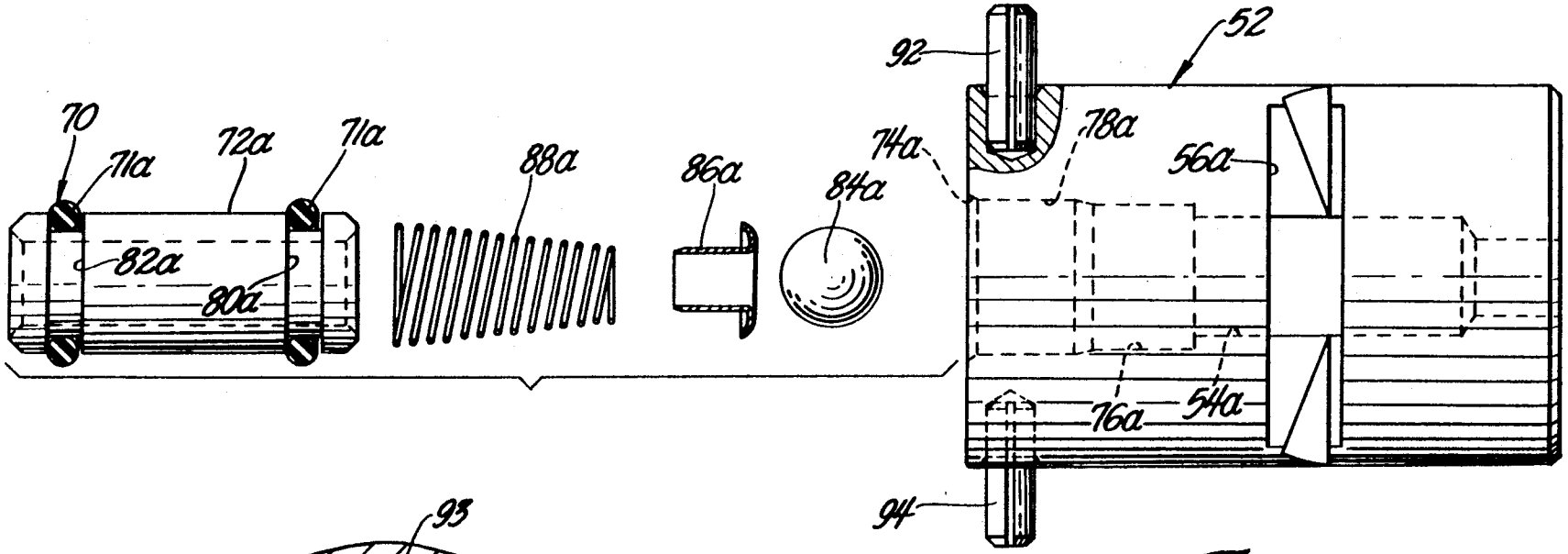
FIG. 2 is an exploded view of the timing valve means and the connector sleeve according to the subject invention.

The seal means 70 preferably comprises a resilient O-ring seal 71*a* manufactured from an organic or synthetic material resistant to hydraulic fluid. The O-ring seal 71*a* has a generally circular cross-section, as shown in FIG. 2, with its outer and inner surfaces perfecting a fluid tight seal over an annular surface area with both the timing valve means 52 and the annular wall 66*a* of the one female transfer valve receptacle 64*a*.

More particularly, the timing valve means 52 includes a pair of male connector sleeves 72*a*, 72*b* extending therefrom as shown best in FIGS. 3 and 4. The connector sleeves 72*a*, 72*b* are generally short cylindrical tubular members dimensioned so as to matingly fit within the female transfer valve receptacles 64*a*, 64*b*, with corresponding sets of O-ring seals 71*a*, 71*b* being disposed between each of the connector sleeves 72*a*, 72*b* and the respective transfer valve receptacles 64*a*, 64*b* to perfect fluid tight seals over an annular surface area each.

Preferably, as shown in the preferred embodiment of FIGS. 1–7, the connector sleeves 72*a*, 72*b* are disjointed from the timing valve means 52. Therefore, in order to properly support the connector sleeves 72*a*, 72*b* , the timing valve means 52 includes a pair of timing valve receptacles 74*a*, 74*b* for receiving the two disjointed connector sleeves 72*a*, 72*b*. The timing valve receptacles 74*a*, 74*b* are formed in an enlarged portion of the fluid carrying passages 54*a*, 54*b*, respectively. The timing valve receptacles 74*a*, 74*b* each include an annular timing valve wall 76*a*, 76*b* and an enlarged annular clearance wall 78*a*, 78*b*, respectively. The disjointed, or separately movable, connector sleeves 72*a*, 72*b* , therefore, convey hydraulic fluid between the respective timing valve receptacle 74a, 74b and the transfer valve receptacle 64a, 64b.

In order to properly retain and support each O-ring seal 71a, 71b, at least one of the transfer valve receptacle 64a, 64b and the connector sleeve 72a, 72b , and likewise one of the timing valve receptacle 74a, 74b and the connector sleeve 72a, 72b , must have some structure to receive and support the O-rings 71a, 71b. In the preferred embodiment, each connector sleeve 72a, 72b is provided with an annular groove 80a, 80b at the forward end thereof, and another annular groove 82a, 82b at the rearward end thereof, as best shown in FIG. 2. The grooves 80a, 80b, 82a, 82b thereby capture the O-ring seals 71a, 71b and prevent them from sliding out of position. Each of the grooves 80a, 80b, 82a, 82b have a depth of slightly less than one half of the radial thickness of the O-ring seals 71a, 71b so that a sufficient portion of the O-ring seal 71a, 71b protrudes outwardly from the connector sleeves 72a, 72b to establish the seal while permitting a degree of radial flexibility and deformability.

Referring now to FIGS. 4 and 5, a simplified fragmentary view of the timing valve means 52 and the transfer valve means 59 is shown with the two connector sleeves 72a, 72b extending therebetween and completing a sealed fluid passage therebetween. In FIG. 4, the timing valve means 52 is shown aligned with the transfer valve means 59 such that the connector sleeves 72a, 72b extend straight and parallel to the central axis. In the unusual event that the cylinder block 32 and timing valve means 52 are manufactured to such an accurate tolerance that there is no appreciable floatation of the timing valve means 52, the timing valve means 52 will remain in the position shown in FIG. 4 during operation of the helm pump 10.

However, as is the more likely situation, slight manufacturing inaccuracies will cause the timing valve means 52 to minutely orbit during operation such that the connector sleeves 72a, 72b are forced to shift from their orientation parallel to the central axis to, at worst, the extreme skewed position shown in FIG. 5. Here, the connector sleeves 72a, 72b are illustrated in a racked orientation due to the shifted timing valve means 52, but with the O-ring seals 71a, 71b maintaining a fluid tight seal over respective annular surface areas. The clearance walls 78a, 78b in the timing valve receptacle 74a, 74b are shown permitting the connector sleeves 72a, 72b to rack to a further degree than would otherwise be possible if the enlarged clearance walls 78a, 78b were not provided.

As the timing valve means 52 floats relative to the transfer valve means 59, and as the connector sleeves 72a, 72b sweep an almost conical path, the inner and outer sealing peripheries of the O-ring seals 71a, 71b compress and expand and slide against their respective abutting surfaces to maintain the fluid tight seal required. Thus, the connector sleeves 72a, 72b and associated O-ring seals 71a, 71b allow the timing valve means 52 to freely orbit as necessitated by manufacturing inaccuracies while establishing and maintaining a fluid tight seal between the moving timing valve means 52 and the stationary transfer valve means 59. The primary advantage of this arrangement is that the timing valve means 52 will radially move with the cylinder block 32 as required. Hence, the interface between the cylindrical recess 53 in the cylinder block 32 and the outer surface of the timing valve means 52 will not wear inordinately fast and will thereby maintain the critical fluid tight yet sliding seal therebetween.

Figure 7:
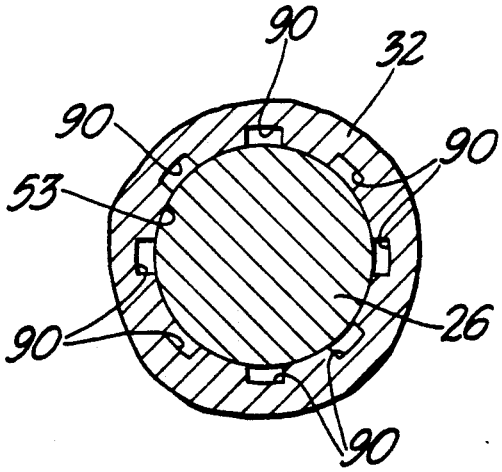
FIG. 7 is a fragmentary cross-sectional view as taken along line 7—7 of FIG. 1.

In FIG. 2, the timing valve means 52 is shown in an exploded view including a check valve arrangement for make-up hydraulic fluid comprising a ball check 84, a guide 86, and a check spring 88 disposed within the fluid carrying passage 54. This arrangement, as shown assembled in FIG. 1, provides a make-up oil system whereby hydraulic fluid in the chamber 20 is drawn into the hydraulic circuit when there is a need. A hydraulic fluid passage is disposed between the drive shaft 26 and the cylindrical recess 53 for conducting hydraulic fluid to the check valve arrangement of the timing valve means 52. More specifically, hydraulic fluid from the chamber 20 is admitted to the ball check 84 through a series of axially extending grooves 90 between the cylindrical recess 53 of the cylinder block 32 and the drive shaft 26, best illustrated in FIG. 7. The grooves 90 can either be formed as male splines on the drive shaft 26 (not shown) or as female splines in the cylindrical recess 53 (FIG. 7). When formed as female splines in the cylindrical recess 53, as shown in FIGS. 1 and 7, the grooves 90 can be economically formed during the formation of the cylinder block 32 wherein a powdered metal process is utilized.

Referring again to FIGS. 1-3, the timing valve means 52 is shown including a rigid pin 92 extending radially therefrom adjacent the pair of connector sleeves 72a, 72b. A second rigid pin 94 is diametrically opposed to the pin 92. The two pins 92, 94 are of the split type permitting a simple force fit assembly to the timing valve means 52.

The forward facing side of the transfer valve means 59 includes two identical pockets 93, 95 disposed adjacent the transfer valve receptacles 64a, 64b for receiving the two rigid pins 92, 94, respectively, of the timing valve means 52. The pins 92, 94 and their corresponding pockets 93, 95 are structured so as to prevent rotation of the timing valve means 52 while permitting the timing valve means 52 to float radially with any irregularities in the manufacture of the cylinder block 32 and/or the timing valve means 52. The pockets 93, 95 of the transfer valve means 59 are sized generously larger than the diameter and radial extent of the pins 92, 94 so that the pins 92, 94, and hence the timing valve means 52, can freely orbit and move radially from side-to-side and up and down without interference from the pockets 93, 95. Yet, the pins 92, 94 are sufficiently long enough that they will not permit appreciable rotation of the timing valve means 52. In FIG. 1, a thrust bearing is shown disposed between the pins 92, 94 and the cylinder block 32, with the rearward outer edge of the thrust bearing seated against the rearward section 16.

DETAILED DESCRIPTION OF THE ALTERNATIVE EMBODIMENT OF FIGS. 8-9

Figure 8:
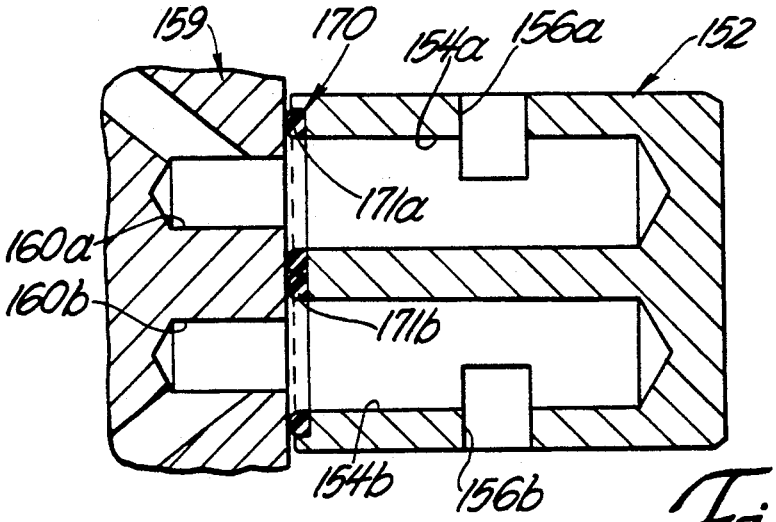
FIG. 8 is a simplified fragmentary cross-sectional view of an alternative embodiment of the seal means with the timing valve means and the transfer valve means being axially aligned.
Figure 9:
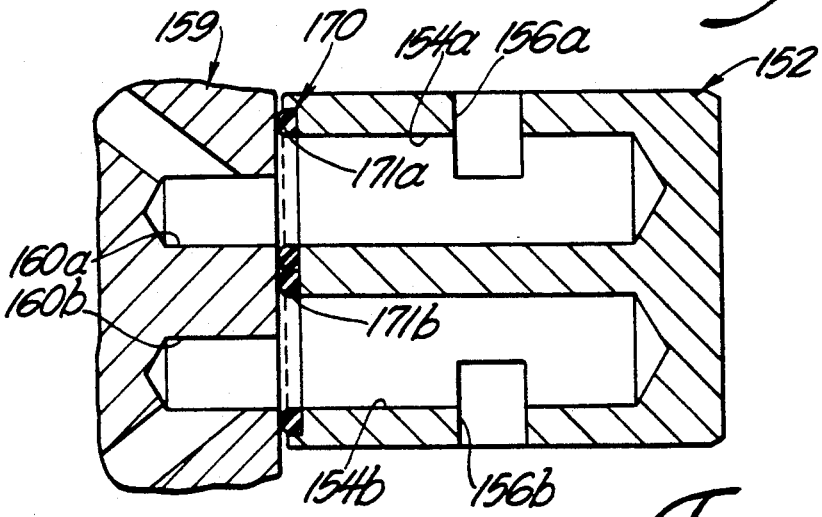
FIG. 9 is a fragmentary cross-sectional view as in FIG. 8 showing the timing valve means shifted laterally.

According to the subject invention, an alternative embodiment of the subject helm pump 110 is provided in FIGS. 8-9 wherein the minutely orbital timing valve means is generally indicated at 152. The timing valve means 152 is held in abutting, or face sealing, engagement with the transfer valve means 159. The timing valve means 152 includes a pair of fluid carrying passages 154a, 154b each having an O-ring seal 171a, 171b disposed at the outer end thereof for perfecting an annular fluid tight face seal with the transfer valve means 159. .

As the timing valve means 152 moves, or floats, radially with the rotation of the cylinder block 132, the O-ring seals 171*a*, 171*b* slide across the forward face of the transfer valve means 159 and maintain the seal over an annular surface area. The O-ring seals 171*a*, 171*b* are supported in a counterbore of the timing valve means 152 to prevent slippage of the O-rings 171*a*, 171*b*. FIG. 9 shows the timing valve means 152 shifted laterally from the position of the timing valve means 152 in FIG. 8, representative of the floatation of the timing valve means 152 occurring during normal operation of the helm pump 110.

DETAILED DESCRIPTION OF THE ALTERNATIVE EMBODIMENT OF FIG. 10

Figure 10:
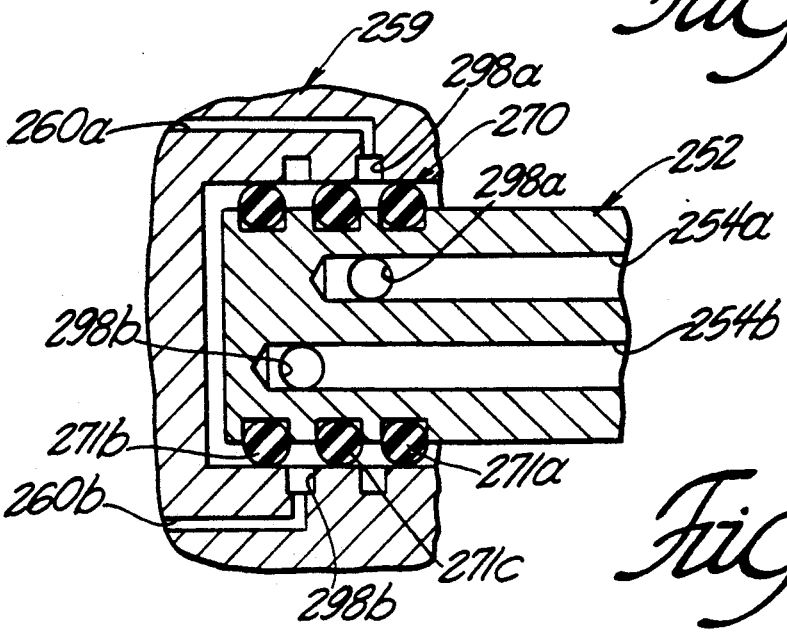
FIG. 10 is a simplified fragmentary cross-sectional view of yet another alternative embodiment of the seal means.

According to a second alternative embodiment of the subject helm pump 210, shown in FIG. 10, the fluid carrying passages 254*a*, 254*b* do not extend completely through to the rearward end of the timing valve means 252. Instead, The fluid carrying passages 254*a*, 254*b* terminate just short of the rearward end of the timing valve means 252 and each include a radial spur 296*a*, 296*b* leading to the outer surface of the timing valve means 252. Three substantially identical O-ring seals 271*a*, 271*b*, 271*c* bound and separate the two radial spurs 296*a*, 296*b* to divide the fluid conveyed through each.

The rearward end of the timing valve means 252 forms a male member in this embodiment and is received into a corresponding female recess in the transfer valve means 259. The two input/output passages 260*a*, 260*b* of the transfer valve means 259 terminate in annular grooves 298*a*, 298*b* which are aligned with the spurs 296*a*, 296*b* of the timing valve means 252 and the divided flow passages defined by the three O-ring seals 271*a*, 271*b*, 271*c*. The O-ring seals 271*a*, 271*b*, 271*c* each engage and perfect an annular seal against the female receptacle 264 in the transfer valve means 259.

This second embodiment of the subject helm pump 210 permits free floatation of the timing valve means 252 by way of the flexibility and resiliency of the O-ring seals 271*a*, 271*b*, 271*c*. Specifically, the three O-ring seals 271*a*, 271*b*, 271*c* will flex, i.e., compress and expand, between the timing valve means 252 and the transfer valve means 259 to maintain a fluid tight seal while simultaneously permitting the timing valve means 252 to freely minutely orbit due to any irregularities in the manufacture of the cylindrical recess 253 of the cylinder block 232 and/or the timing valve means 252.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A hydraulic pump assembly (10) for a marine steering system for remotely actuating a submerged steering element, said assembly comprising: a housing (12); a compression chamber (40) disposed in said housing (12); a piston (40) slidably disposed in said compression chamber (40); actuator means (48) for reciprocating said piston in said compression chamber (40) in response to a rotary input; timing valve means (52) minutely orbitally disposed in said housing (12) for alternately transferring hydraulic fluid to and from said compression chamber (40); transfer valve means (59) extending through said housing (12) and fixed relative to said minutely orbital timing valve means (52) for conveying hydraulic fluid between the steering system and said timing valve means (52); and characterized by annular elastically deformable seal means (70) interconnecting said fixed transfer valve means (59) and said minutely orbital timing valve means (52) over an annular surface area for permitting minute orbital movements of said timing valve means (52) while perfecting and maintaining an annular fluid tight seal with said transfer valve means (59) such that said timing valve means (52) freely minutely orbits without leakage of hydraulic fluid between said fixed transfer valve means (59).

2. An assembly (10) as set forth in claim 1 further characterized by said seal means (70) comprising a resilient O-ring seal (71*a*, 71*b*) having a generally circular cross-section.

3. An assembly (10) as set forth in claim 2 further characterized by said timing valve means (52) including a male connector sleeve (72*a*, 72*b*) extending therefrom and said transfer valve means (59) including a female transfer valve receptacle (64*a*, 64*b*) for receiving said connector sleeve (72*a*, 72*b*), with said O-ring seal (71*a*, 71*b*) being disposed between said connector sleeve (72*a*, 72*b*) and said transfer valve receptacle (64*a*, 64*b*).

4. An assembly (10) as set forth in claim 3 further characterized by one of said transfer valve receptacle (64*a*, 64*b*) and said connector sleeve (72*a*, 72*b*) having an annular groove (80*a*, 80*b*) for supporting said O-ring (72*a*, 72*b*).

5. An assembly (10) as set forth in claim 4 further characterized by said annular groove (80*a*, 80*b*) being disposed about said connector sleeve (72*a*, 72*b*).

6. An assembly (10) as set forth in claim 5 further characterized by said connector sleeve (72*a*, 72*b*) being disjointed from said timing valve means (52), and said timing valve means (52) including a timing valve receptacle (74*a*, 74*b*) for receiving said disjointed connector sleeve (72*a*, 72*b*).

7. An assembly (10) as set forth in claim 6 further characterized by including a second O-ring seal (71*a*, 71*b*) disposed between said timing valve receptacle (74*a*, 74*b*) and said connector sleeve (72*a*, 72*b*).

8. An assembly (10) as set forth in claim 7 further characterized by one of said timing valve receptacle (74*a*, 74*b*) and said connector sleeve (72*a*, 72*b*) including a second annular groove (82*a*, 82*b*) for supporting said second O-ring seal.

9. An assembly (10) as set forth in claim 8 further characterized by said second annular groove (82*a*, 82*b*) being disposed about said connector sleeve (72*a*, 72*b*).

10. An assembly (10) as set forth in claim 9 further characterized by said timing valve means (52) including a rigid pin (92) extending radially therefrom.

11. An assembly (10) as set forth in claim 10 further characterized by said transfer valve means (59) including a pocket (93) disposed r adjacent said transfer valve receptacle (64*a*, 64*b*) for receiving said rigid pin (92) of said timing valve means (52).

12. An assembly (10) as set forth in claim 11 further characterized by said timing valve means (52) including a pair of said rigid pins (92, 94) diametrically opposed from one another, and said transfer valve means (59) including a pair of said pockets (93, 95) diametrically opposed from one another to receive said pair of rigid pins (92, 94).

13. An assembly (10) as set forth in claim 12 further characterized by including a pair of bearings (34, 36) spaced apart in said housing (12) for rotatably supporting said compression chamber (40) independently of said timing valve means (52).

14. An assembly (10) as set forth in claim 13 further characterized by including a drive shaft (26) supported for rotation in said housing (12) and having an axis parallel to and aligned with said timing valve means (52).

15. An assembly (10) as set forth in claim 14 further characterized by said compression chamber (40) extending parallel to said axis.

16. An assembly (10) as set forth in claim 15 further characterized by including a plurality of said compression chambers (40) disposed in equal radial and circumferential increments about said axis, with each of said compression chambers including a piston (42) slidably disposed therein.

17. An assembly (10) as set forth in claim 16 further characterized by said housing (12) including means for accommodating thermal expansion of the hydraulic fluid retained said housing (12).

18. An assembly (10) as set forth in claim 17 further characterized by said means for accommodating thermal expansion including at least one rib (24) extending inwardly from said housing (12).

19. An assembly (10) as set forth in claim 18 further characterized by said timing valve means including a make-up fluid check valve arrangement.

20. An assembly (10) as set forth in claim 19 further characterized by said compression chambers (40) being supported in a cylinder block (32), said cylinder block (32) having a centrally disposed cylindrical recess (53) for matingly receiving said timing valve means (52) and said drive shaft (26).

21. An assembly (10) as set forth in claim 20 further characterized by including a hydraulic fluid passage disposed between said drive shaft (26) and said cylindrical recess (53) for conducting hydraulic fluid to said check valve arrangement of said timing valve means (52).

22. An assembly (10) as set forth in claim 21 further characterized by said hydraulic fluid passage comprising at least one groove (90) disposed between said drive shaft (26) and said cylindrical recess (53).

* * * * *